United States Patent [19]

Hong

[11] Patent Number: 4,712,039

[45] Date of Patent: Dec. 8, 1987

[54] VACUUM INTEGRATED CIRCUIT

[76] Inventor: Lazaro M. Hong, 931 Kingston Dr., Fort Collins, Colo. 80525

[21] Appl. No.: 850,945

[22] Filed: Apr. 11, 1986

[51] Int. Cl.[4] ..... H01J 1/46; H01J 21/10; H01K 11/00

[52] U.S. Cl. ..... 313/307; 313/306; 313/308; 313/310; 313/325; 313/245; 313/254; 307/299.1

[58] Field of Search ..... 313/306, 307, 309, 310, 313/311, 250, 623, 494, 496, 497, 490, 422; 307/299 R; 357/53

[56] References Cited

U.S. PATENT DOCUMENTS

| | | | |
|---|---|---|---|
| 3,041,481 | 6/1962 | Peters, Jr. et al. | 310/4 |
| 3,138,622 | 2/1979 | McCormick et al. | 313/306 |
| 3,148,298 | 9/1964 | Goncz | 313/106 |
| 3,441,782 | 4/1969 | Arnaud | 315/3.5 |
| 3,701,919 | 10/1972 | Geppert | 313/250 |
| 3,748,522 | 7/1973 | Geppert | 313/310 |
| 3,824,478 | 7/1974 | Mueller | 328/37 |
| 3,978,364 | 8/1976 | Dimeff et al. | 313/306 |
| 4,069,436 | 1/1978 | Nakayama et al. | 313/302 |
| 4,178,531 | 12/1979 | Alig | 313/409 |
| 4,513,308 | 4/1985 | Greene et al. | 357/55 |
| 4,578,614 | 3/1986 | Gray et al. | 313/309 |

*Primary Examiner*—David K. Moore
*Assistant Examiner*—Mark R. Powell
*Attorney, Agent, or Firm*—Cahill, Sutton & Thomas

[57] ABSTRACT

An integrated circuit including a plurality of active devices each including a thermionic cathode or a cold cathode, an anode, and a grid element, all coplanarly disposed on an insulating substrate in a vacuum. A plurality of electrostatic lens elements also are exposed on the substrate to produce electric fields that control the trajectories of electrons emitted by the cathodes to prevent the electrons from migrating to and charging up exposed portions of the substrate and the inner surface of the vacuum envelope and thereby preventing such charge buildup from altering the electrical characteristics of the active devices.

16 Claims, 15 Drawing Figures

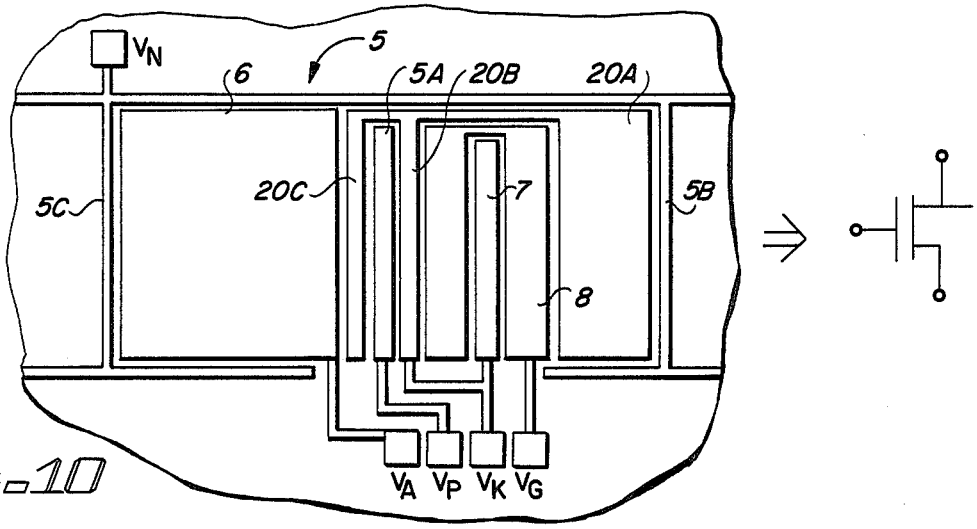
FIG. 10
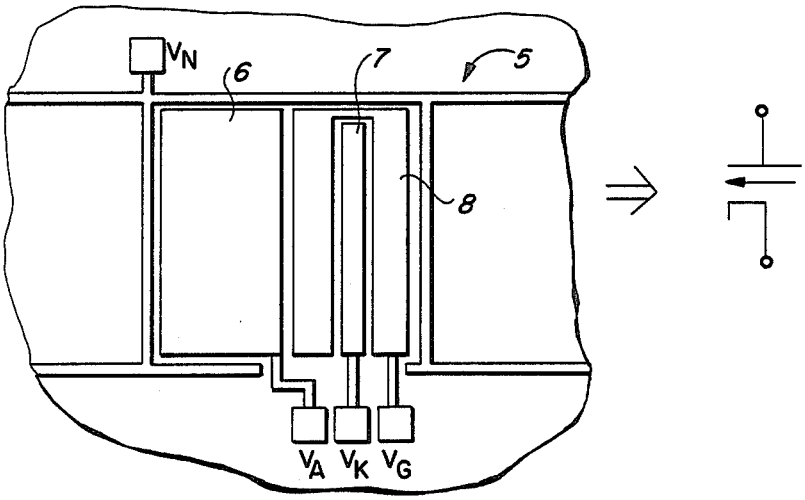
FIG. 11
FIG. 12
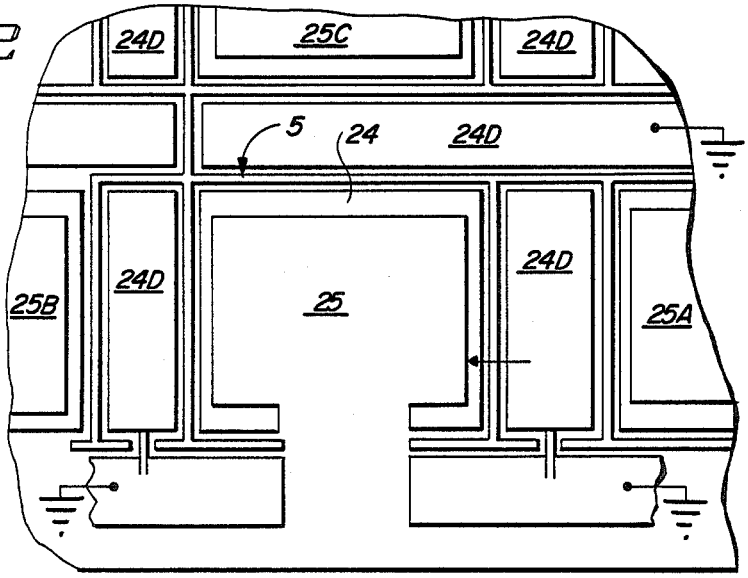
FIG. 13
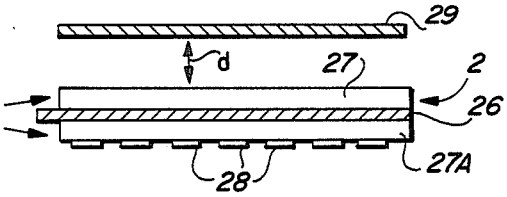

VACUUM INTEGRATED CIRCUIT

BACKGROUND OF THE INVENTION

The invention relates to vacuum integrated circuits of the type having thermionic cathodes or cold cathodes, grid elements, and anodes operative in a vacuum, and more particularly to improvements therein that permit stable, reliable operation of a plurality of such devices within a single vacuum region.

Although semiconductor integrated circuits (ICs) are widely used and are highly reliable, and are very inexpensive, there are certain applications for which conventional semiconductor integrated circuits are poor suited. Generally, operating temperature ranges of semiconductor integrated circuits are between about −65° C. and +200° C. Although high power semiconductor devices are available, most semiconductor integrated circuits are limited to relatively low power applications. Many semiconductor devices have lower bandwidth than can be achieved with suitably designed vacuum integrated circuits. This is due to the low grid-cathode interelectrode capacitance. Bipolar and MOS integrated circuits become inoperative in the presence of large amounts of nuclear and electromagnetic radiation, as would occur in the event of nuclear explosions. It is estimated that most "silicon based" electronics would be destroyed by the electromagnetic pulses (EMP) produced by nuclear detonations. All of the common semiconductor integrated circuit manufacturing processes are highly refined, complex, inexpensive processes in which minor variations can result in great reductions in IC manufacturing yield. Minute defects in the semiconductor material also can result in costly reduction in IC manufacturing yields.

Consequently, there are certain applications in which there would be a good market for stable, reliable vacuum integrated circuits, if such could be economically manufactured. Therefore, considerable research and effort has been directed to developing a reliable, manufacturable vacuum integrated circuit, as indicated in U.S. Pat. Nos. 3,701,919, 3,978,364, 4,138,622, which are generally indicative of the state-of-the-art.

The device vacuum integrated circuit shown in U.S. Pat. No. 3,701,919 (Geppert) is a coplanar device. A great deal of capital and approximately three years of time were spent by Electron Emission Systems, a subsidiary of Baldwin Electronics Company of Hot Springs, Ark. in attempting to develop the disclosed structures, before the project failed. The structure shown in FIG. 3A of the Geppert reference discloses two cascaded triodes in a coplanar structure that is enclosed within a vacuum chamber. Reliable operation of one triode of the structure was achieved as a result of electron charge build-up on the inner walls of the glass vacuum envelope, but no success was achieved in providing more than one triode structure capable of stable, simultaneous operation in the same vacuum envelope. I believe that the failure of the Geppert devices to operate reliably was a result of not having the proper device elements for producing the necessary electric fields which would allow the anode to collect all the electrons emitted by the cathodes of the same device. At the same time in the Geppert devices there were extraneous electric fields induced as a result of build up on various interior surfaces of the glass vacuum envelope by electrons emitted from the cathodes. These electric fields repelled the electrons from the cathode of the single triode back to the anode where they are supposed to be collected. However, for the case of multiple triodes, the repelled electrons originating from a given device cathode are collected by the anodes of other devices. This cross-talk between devices severely degrades the desired circuit performance.

To bypass the problem of the Geppert structure, all subsequent device development has been in the area of biplanar structures (e.g., U.S. Pat. Nos. 3,978,364 and 4,138,622) wherein the anode is directly above the cathode and is able to collect a large percentage of electrons emitted by the cathode. The biplanar structure has the following disadvantages:

1. Two substrates have to be designed and fabricated using two different mask sets.

2. The substrates have to be accurately aligned. The device performance depends critically on the alignment. As the device geometry gets smaller, the alignment becomes even more critical and increasingly more difficult.

3. The distance between substrates is critical in determining the device characteristics and is difficult to control accurately over the entire surface of both substrates.

4. To make low voltage operating devices, the distance between substrates has to be made smaller. The smaller this distance is made, the more difficult it becomes to control it accurately. For thermionic cathodes using the emission carbonates, the two closely spaced substrates make pumping of the gases evolved during cathode activation difficult. The high pressure developed in the region between the two substrates could be potentially harmful to proper cathode activation.

5. Since the metal films on the substrates are thin films, it is difficult to make low and high voltage operating devices on the same substrate because it is difficult to make anodes which are at large varying distances from the cathodes.

All of these problems are avoided with the planar structure, since complete circuits are made on a single substrate and the dimensions of structures on the substrate are controleld by photolithographic techniques which are accurate to within one micron dimensions.

Thus, there remains an unmet need for an improved, reliable, reasonably inexpensive, and hence coplanar integrated circuit operable in a single vacuum chamber.

SUMMARY OF THE INVENTION

Accordingly, it is an object of the invention to provide an integrated circuit reliably operable on a single substrate and in a single vacuum envelope.

It is another object of the invention to provide an integrated circuit operable in a single vacuum envelope, which avoids unreliable operation by avoiding buildup of electrons on the interior surfaces of the vacuum envelope.

Briefly described, and in accordance with one embodiment thereof, the invention provides a PREF lens (pseudo-radial electrostatic field lens) with a planar triode structure including a cathode, an anode, and a grid in a vacuum chamber on a planar substrate. The PREF lens structure creates strong, well-defined electric field lines that control the trajectories of electrons emitted by the cathode, and causes them to terminate on or be collected by the intended anode and prevents emitted electrons from migrating to and charging up various other surfaces within the vacuum chamber, and thereby prevents generation of extraneous electric fields that prevent some of the emitted electrons from traveling to the correct anode. In the described embodiment of the invention, a plurality of active devices, including diodes, triodes, enhancement mode devices, and depletion mode devices are described. A version of the device of the present invention having a negative resistance characteristic also is described. Extended anode structures that perform the function of triodes are provided. Grounded shield elements are provided that cover exposed portions of the substrate in structures wherein the anode is considerably spaced from the cathode thus preventing charge build up on the insulating substrate. These grounded shield elements, when placed next to large positive voltage elements, such as anodes and positive lens electrodes, act as suppressors of secondary electrons by providing an electric field which forces the secondary electrons back to the large positive voltage elements. Either thermionic cathodes or cold cathodes can be utilized. A variety of circuits including triode-type active devices and devices having pentode-like characteristics are utilized as active devices. Diode-like structures are used as active load devices in certain circuits, such as differential amplifiers and inverting amplifiers. For cold cathode operation, passive load as well as active load devices may be utilized. A guard ring shield structure surrounding the device is provided within the PREF structure in one embodiment of the invention, along with other shields between devices, which reduce electrostatic interactions between such devices. In another embodiment of the invention, as intrasubstrate shield structure is provided between the heater and the cathode to eliminate electrostatic interactions between the heater and the thermionic devices.

BRIEF DESCRIPTION OF THE DRAWINGS

FIG. 10 is a top view of a vacuum depletion mode device.

FIG. 11 is a top view of a vacuum negative resistance device.

FIG. 12 is a top view illustrating guard shield structures that can be used to surround the various vacuum integrated circuit devices of the present invention.

FIG. 13 is a section view diagram of a substrate and shield structure of an alternate embodiment of the invention.

DESCRIPTION OF THE INVENTION

Figure 1:
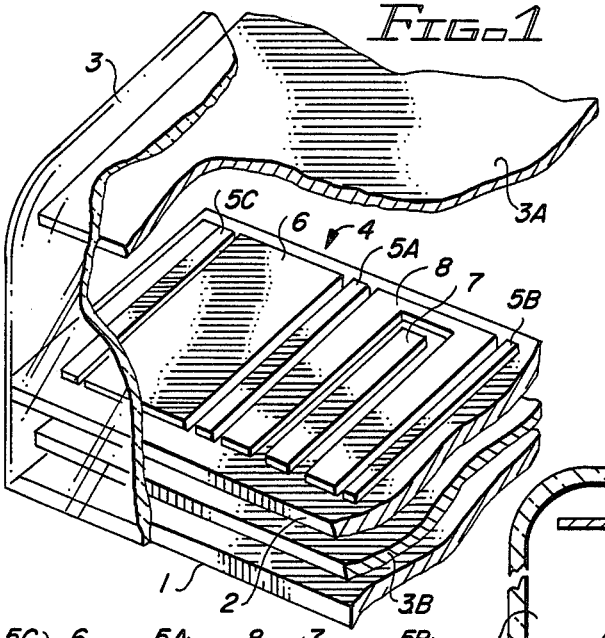
FIG. 1 is a partial cutaway perspective view illustrating one simplified basic device structure which is used to illustrate the PREF lens structure of the present invention, wherein all elements of the structure are disposed in coplanar fashion on the substrate.
Figure 2A:
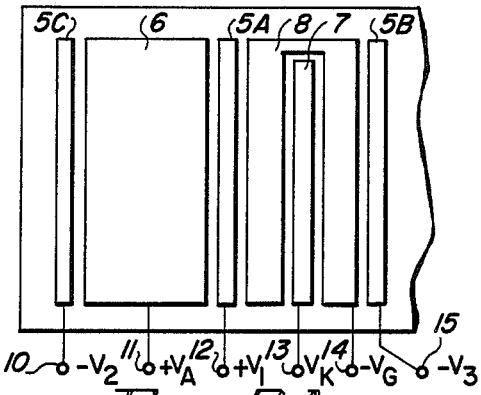
FIG. 2A is plan view of the device shown in the structure of FIG. 1.
Figure 2B:
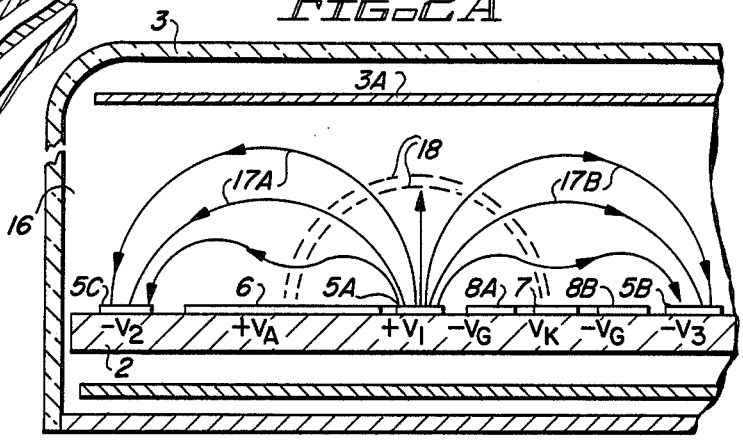
FIG. 2B is a section view of the device shown in FIG. 1.

Referring now to FIGS. 1, 2A and 2B, vacuum integrated circuit 1 includes an insulating (sapphire or ceramic) substrate 2 enclosed by a metal envelope or housing 3. The metal envelope 3 defines a vacuum region 16 in which the vacuum integrated circuit of the present invention forms electric fields in which electrons move ballistically.

FIGS. 1, 2A, and 2B show only one thermionic active device, although in accordance with the invention, many are provided on a single substrate (as shown in FIG. 12), with suitable interconnections therebetween. A suitable heater, not shown, provided in thermal contact with insulating substrate 2 to raise the temperature of cathode 7 to the temperature necessary (500° C. to 1000° C.) to cause thermionic emission of electrons.

Device 4 includes a cathode 7 disposed on the upper surface of sapphire substrate 2. Cathode 7 is composed of a suitable metal layer approximately 0.5 microns thick upon which an electron emissive cathode material 2 to 5 microns thick is deposited. Cathode 7 can be about 100 mils long and 25 microns wide. A U-shaped grid element 8 is disposed so that its legs 8A and 8B (FIG. 2B) are disposed on either side of cathode 7. Grid 8 is composed of similar metal. The spacings between elements shown in the drawings can be about 12 microns, and the minimum line width can be about 25 microns, although large or smaller line widths and spacings could be used with consequent changes in device characteristics.

The above-described grid and cathode structure is located between two metal elecrostatic lens elements 5A and 5B on insulating substrate 2 in coplanar relationship with the cathode 7 and grid 8.

An anode 6 has a length of about 100 mils and a width of about 100 microns. Anode 6 is positioned between electrostatic lens element 5A and electrostatic lens element 5C.

As indicated in FIG. 2A, suitable conductors are provided for applying various voltages to the three electrostatic lens elements 5A–5C and to anode 6, cathode 7, and grid 8, respectively. More specifically, a negative voltage $V_2$ is applied by conductor 10 to electrostatic lens element 5C. $-V_2$ can be in the range from $-40$ volts to $-100$ volts for the above-described structure. A positive voltage $+V_A$ is applied by conductor 11 to anode 6. $+V_A$ typically is in the range from about $+0$ volts to $+50$ volts in the described embodiment of the invention. A positive voltage $+V_1$ is applied by conductor 12 to center electrostatic lens element 5A. $+V_1$ typically is in the range from $+40$ volts to $+100$ volts. The cathode voltage $V_K$ is applied by conductor 13 to cathode 7. Typically, $V_K$ might be 0 volts. A negative voltage $-V_G$ is applied by conductor 14 to grid 8. $-V_G$ typically is in the range from $+10$ volts to $-10$ volts in the described structure. Finally, $-V_3$ is applied by conductor 15 to electrostatic lens element 5B, and typically is in the range from $-40$ to $-100$ volts.

The basic concept of the present invention is to control the motion of electrons in such a way that the anode colelcts all the electrons emitted by the cathode of the same device and to avoid the above-mentioned charging up of various inner surfaces bounding the vacuum region 16 by electrons which are emitted by cathode 7, but which fail to be collected by anode 6. As mentioned above, if such inner surfaces of region 16 become charged up by uncollected electrons, electric fields are modified in the vacuum regions and prevent reliable operation of the vacuum integrated circuit therein by severely altering the various active device operating characteristics.

In accordance with the present invention, the three electrostatic lens elements 5A, 5B, and 5C, which I refer to as a PREF (pseudo-radial electrostatic field) lens, generate strong electric fields, designated in FIG. 2 by lines 17A between lens element 5A and 5C and by reference numeral 17B between lens elements 5A and 5B. The layout design is such that the electric field 17A is considerably greater in intensity than the electric field produced between cathode 7 and anode 6 by the anode-to-cathode voltage $V_{AK}$. Then, the strong electric fields 17A and 17B cause any emitted electrons that fail to be collected by anode 6 to travel in such a way as to be collected by the positive center lens element 5a, rather than on the inner surfaces of the vacuum envelope 3 or on exposed surfaces of insulating substrate 2. Alteration of the device operating characteristics thereby is avoided.

For proper operation of diodes, triodes, current sources, enhancement and depletion mode devices, the vast majority of the cathode current should be collected by its corresponding anode. This will be true if the cathode electrons have velocities normal to the plane of the insulating substrate surface. Electrons that have components of velocity parallel to the plane of the insulating substrate will be less likely to be collected by the appropriate anode, the larger this parallel component of velocity is. Thus, for optimum performance of these device structures, the cathodes should be designed so that the electrons have large normal components of velocity and small or zero parallel components of velocity.

Those skilled in the art will realize that electrons emitted by cathode 7 have a considerable velocity, and hence momentum, just a few thousand angstroms away from the virtual cathode due to the electric fields normal to the virtual cathode surface. The purpose of the pseudo-radial field 17A,17B is to cause those electrons to move in approximately semicircular orbits designated by dotted lines 18, so that the emitted electrons travel ballistically from cathode 7 to anode 6. None of the emitted electrons ever reach the negatively biased outer lens elements 5B and 5C.

Any emitted electrons that do not follow the semicircular orbit 18 are most likely to be collected by the positive center lens element 5A. I performed experiments on the above-described device, wherein a current meter was attached to a metal shield 3A to measure the current flowing therein as a result of migration of emitted electrons to the metal shield 3A. The measured current was negligibly small, less than 0.08 microamperes, when metal shield 3A was at 0 volts and the cathode current was about 22 microamperes.

Therefore, I concluded that very few emitted electrons reached the inner surface of metal shield 3A, and therefore the buildup of extraneous electric fields that plagued the device described in the Geppert reference was avoided by the PREF lens structure provided by the present invention.

In my experimental structure, the minimum widths of the lens elements, the cathode, and the grid are about 25 microns and the width of the anode is about 60 microns. The minimum spacings between different conductors is about 12 microns. The thicknesses of each are about 0.5 microns. The basic layout of the structure is provided using conventional photolithographic techniques. The thermionic cathode 7 is provided by mixing a commercially available cathode powder, designated as C14 powder, which is a combination of barium, strontium, and calcium carbonates, with commercially available photoresist and depositing it photolithographically on the cathode conductor 7 to make it thermionically emissive.

Figure 5:
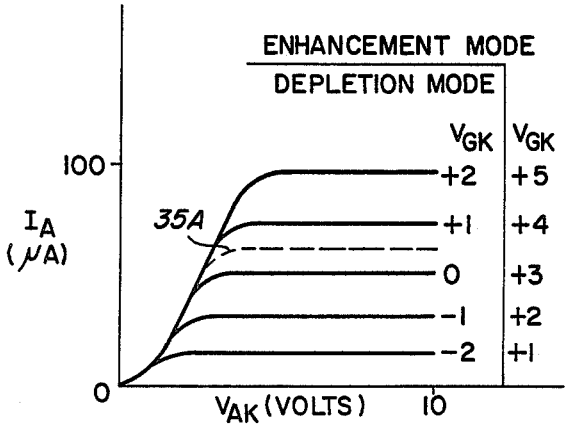
FIG. 5 is a family of anode current versus anode voltage curves for the devices of FIGS. 8, 9, and 10.

The device shown in FIGS. 1, 2A, and 2B has the current-voltage characteristic shown in FIG. 5, where $I_A$ is the current flowing through anode 6, $V_{AK}$ is the voltage applied between the cathode 7 and the anode 6, and $V_{GK}$ is the voltage applied between the grid 8 and the cathode 7.

The anode current for the above-described structure can be given by the following equation:

$$I_A = K\left[\alpha_v V_{AK} + \mu V_{GK} + \sum_{i=1}^{N} \mu_{eik} V_{eik}\right]^n \quad (1)$$

wherein n equals 3/2, but may deviate some from the 3/2 power, $\mu$ is the amplification factor given by equation (1.3), $\mu_{eiG}$ is the amplfication of the ith electrode of N other electrodes that may be in the same vacuum regions in the integrated circuit structure, $V_{eik}$ is the voltage between present cathode 7, $X_{AK}$ is the distance between the anode 6 and the cathode 7, $W_A$ is the width of anode 6, K is a constant called the perveance, and $\alpha_v$, the voltage scaling factor for a strucure without a top shield is given by the equation:

$$(1.1)\ \alpha_v = \frac{2d_1}{\pi}\left[\frac{W_A}{X_{AK}(X_{AK} + W_A)}\right]$$

and the voltage scaling factor for a planar structure with a circuit top shield is given by the equation:

$$(1.2)\ \alpha_v = \frac{2d_1}{d}\left[\frac{1}{e^{\frac{\pi}{d}X_{AK}} - 1} - \frac{1}{e^{\frac{\pi}{d}(X_{AK}+W_A)} - 1}\right],$$

where d is the distance between the top shield and the substrate for a planar structure, and $d_1$ is the distance between the anode and cathode of a biplanar structure, as explained in the Appendix.

The right-hand term in the brackets of equation (1) represents a change in $I_A$ caused by the voltages present on i other electrodes mH that may be in the same vacuum space.

The amplification factor is given by:

$$(1.3)\mu = \frac{W_G X_{AK}(X_{AK} + W_A)}{W_A X_{GK}(X_{GK} + W_G)}$$

for a plana structure without a circuit top shield, and is given by:

$$(1.4)\ \mu = \frac{\dfrac{1}{e^{\frac{\pi}{d}X_{GK}}-1} - \dfrac{1}{e^{\frac{\pi}{d}(X_{GK}+W_G)}-1}}{\dfrac{1}{e^{\frac{\pi}{d}X_{AK}}-1} - \dfrac{1}{e^{\frac{\pi}{d}(X_{AK}+W_A)}-1}}$$

for a planar structure with a circuit top shield, as shown in FIG. 12,

The anode resistance is given by the equation:

$$r_A = \frac{1}{\left(\dfrac{dI_A}{dV_{AK}}\right)} \quad (2)$$

$V_{GK}$ = const.
$V_{eik}$ = const.

The transconductance of the structure described is given by the following equation:

$$g_m = \left(\frac{dI_A}{dV_{GK}}\right) \quad (3)$$

$V_{AK}$ = const.
$V_{eik}$ = const.

From this, it can be shown that the following general relation is valid:

$$g_m = \frac{\mu}{r_A \alpha v} \quad (4)$$

The derivation of these equations can be obtained from Appendix attached hereto.

Figure 3A:
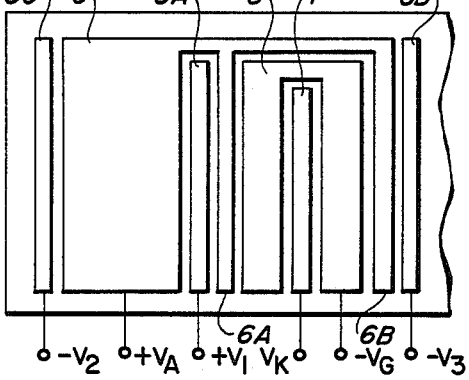
FIG. 3A is a plan view of a simplified triode structure which illustrates the basic triode design in accordance with the present invention.
Figure 3B:
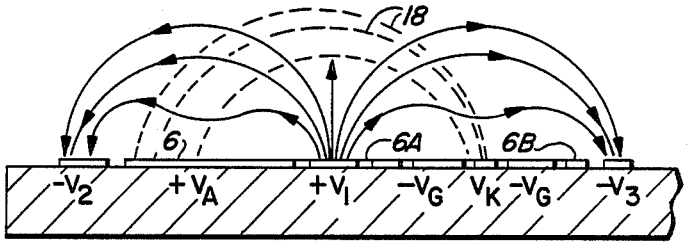
FIG. 3B is a section view illustrating the structure of FIG. 3A.

Now that the basic vacuum integrated circuit structure has been described, a number of practical variations of the above structure will be described. In FIGS. 3A and 3B, a structure similar to that of FIGS. 2A and 2B is shown, except that a narrow portion of the anode 6 has been extended to the right to provide two narrow extensions 6A and 6B positioned between center lens element 5A and grid 8, and between grid 8 and right lens element 5B, respectively. The device shown in FIGS. 3A and 3B is a triode structure, rather than a current source structure as shown in FIGS. 2A and 2B.

The extensions 6A and 6B of the anode 6 located in close proximity to the cathode-grid structure enable the anode voltage $V_A$ to control the emission of electrons from the cathode 7, enabling the device of FIGS. 3A and 3B to function as a triode active gain device. The emitted electrons move in the semicircular orbits 18 due to the presence of the pseudo-radial fields 17A and 17B as described previously. However, in the structure of FIGS. 2A and 2B, the anode voltage has very little effect on the electric field at the surface of the electron-emitting cathode. Therefore, the anode current $I_A$ in the corresponding curves of FIG. 5 is nearly constant with respect to the anode-to-cathode voltage $V_{AK}$.

It should be appreciated that in the above-described structures, the magnitudes of the lens voltages $V_1$, $V_2$, and $V_3$ are chosen so that they are much greater than any of the other voltages $V_{AK}$ and $V_{GK}$ applied to the device. This ensures that the electric fields produced by the PREF lens structure is not disturbed much by the electric fields produced by the other electrodes.

The metals used for producing the lens, anode, grid, and cathode elements shown in the drawings ordinarily should be selected from the group including titanium, molybdenum, tungsten, platinum, and nickel in order to withstand the high temperatures, typically 500° C. to 1000° C., usually present in thermionic devices. If cold cathode mission is used, of course, then different metals, such as aluminum could be used.

Figure 6:
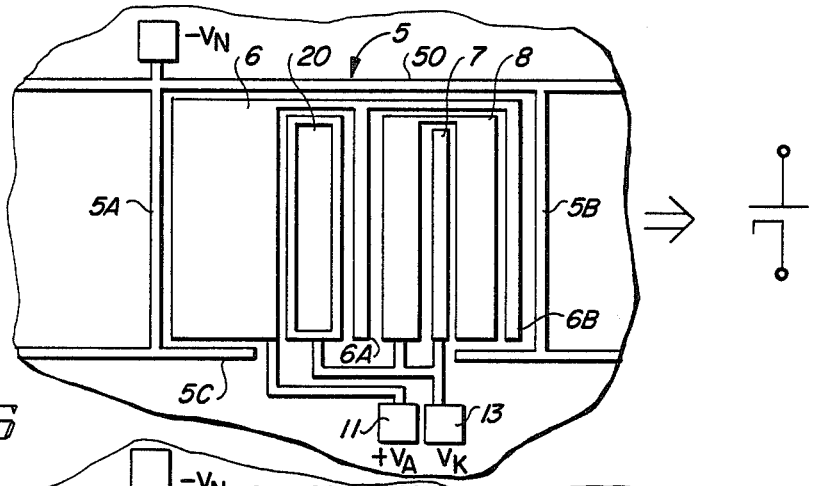
FIG. 6 is a top view diagram of a vacuum diode structure.

Referring now to FIG. 6, a diode structure is shown. In this structure, reference numeral 5 designates a conductive lens element to which a negative bias voltage $-V_N$ is applied. (In FIGS. 6–11, circuit symbols are shown which will have a familiar appearance to those familiar with various tube circuits.) This lens element corresponds to the two negatively biased outer lens elements 5B and 5C of FIG. 2A and 3A. It includes a top member 5D, and two bottom members 5C having a gap therebetween to allow the various applied voltage conductors 11 and 13 to be connected to the extended anode structure 6, a shield element 20, grid 8, and cathode 7. $-V_N$ typically is about $-40$ to $-100$ volts. $V_K$ typically is at ground, and $V_A$ typically varies between ground and $+20$ to $+50$ volts.

The purpose of ground shield 20 is to suppress secondary electrons that are emitted by anode 6 as a result of electrons impinging thereon. The diode of FIG. 6 can be used as an active load. The effective resistance of the active load is determined by the widths of anode 6A and 6B and their distance from the cathode. The current-voltage characteristic curves of the diode of FIG. 6 is indicated by curve 33 in FIG. 4.

It should be understood that shield element 20 could be omitted, but if anode 6 is spaced quite a distance from cathode 7 (in order to make the current-voltage characteristics of the diode depend only on anode elements 6A and 6B), then the resulting exposed surface of insulating substrate 2 needs to be covered to prevent charge from building up thereon.

Figure 7:
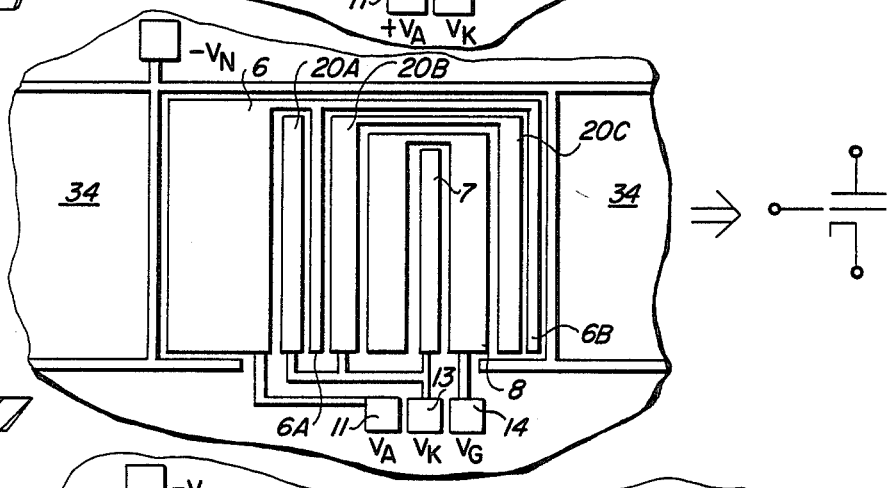
FIG. 7 is a top view diagram of a vacuum triode structure.

Referring next to FIG. 7, an exemplary triode structure is disclosed. It has the same negative lens element as is shown in FIG. 6. The negative lens element structure bounds the illustrated triode structure, and also bounds adjacent thermionic active elements (not shown) in the adjacent spaces designated by reference numerals 34. The triode in FIG. 7 differs from the one shown in FIG. 3A in that shield elements 20A, 20B, and 20C, all electrically connected to cathode voltage $V_K$ by conductor 13, are provided to accomplish the function of suppressing secondary emission and preventing electron charging effects on the substrate surface.

Shield element 20A provides the function of collecting secondary electrons emitted by anode 6 as electrons from cathode 7 impinge on anode 6. The width of shield element 20A can also be changed so that anode 6 is further away from the cathode and therefore has less affect on the amplification factor of the device. Thus the amplification factor is essentially determined by anodes 6A and 6B which are close to cathode 7 and not be anode 6. The amplification factor will be determined by the distance of grids 8A and 8B from the cathode, by the width of anodes 6A and 6B and by the widths of grids 8A and 8B. Anode 6 serves as the main collector of electrons for the structure. Shield elements 20B and 20C perform the function of suppressing secondary emission from anode 6A and 6B by cathode electrons impinging on anode 6A and 6B. For a given device amplification factor anodes 6A and 6B will be a given distance away from grids 8A and 8B. Shields 20B and 20C prevent charge build up on the insulating substrate between anodes 6A and 6B and grids 8A and 8B. In the triode of FIG. 7, the function of the center lens element 5B of FIG. 3A is performed by leg 6A and to some degree of anode 6.

The focusing of emitted electrons on the anode for a given electron velocity is accomplished by applying the appropriate voltage on the lens element. In most triodes, the anode voltage is high enough and the devices can be designed in such a way that the needed focusing field is accomplished by a portion of the anode; this enables the positive electrostatic lens element to be omitted, reducing the size of the device and reducing the number of interconnecting lines needed.

Figure 8:
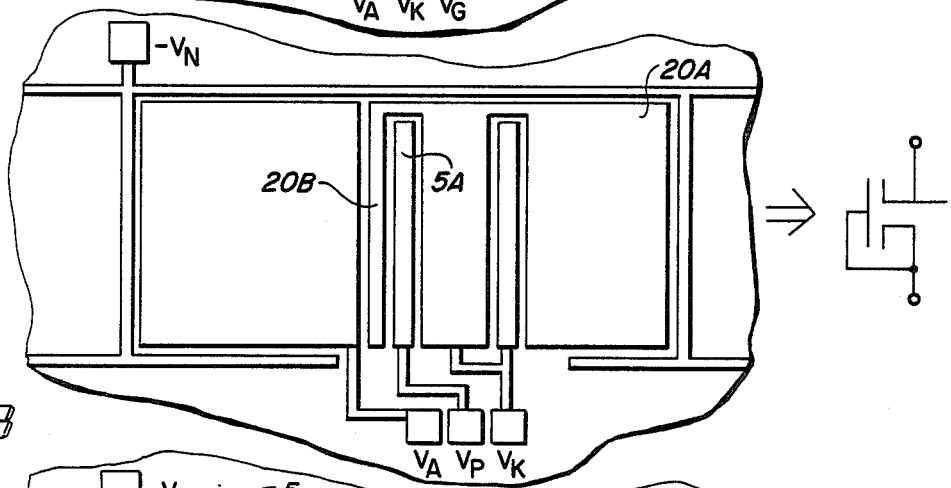
FIG. 8 is a top view of a vacuum current source device.

FIG. 8 shows an improved current source design in which the positive lens element 5A is surrounded by a ground shield 20A, which suppress secondary emissions, and results in improved operation over that of the basic structure of FIG. 2A.

Figure 9:
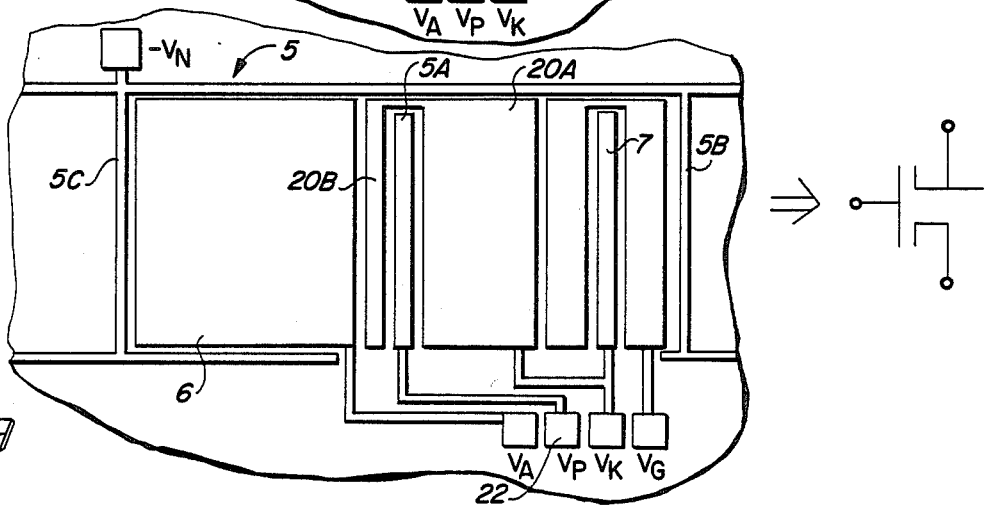
FIG. 9 is a top view of a vacuum enhancement mode device.

Referring next to FIG. 9, an enhancement mode structure is shown. In this device, the cathode 7 is quite close to negatively biased lens conductor 5B. This structure results in a fairly strong electric field being established by leg 5B of the negative lens conductor 5 on the surface of cathode 7. Since the positive lens element 5A is further away from the cathode, for equal but opposite magnitude voltages on 5A and 5B, the electric field due to 5B will dominate. This electric field tends to turn off cathode 7. In the enhancement mode device shown in FIG. 9, no anode current will flow if the grid-to-cathode voltage ($V_{GK}$) is less than a predetermined threshold voltage ($V_T$), regardless of how large the voltage $V_{AK}$ might be in its designed operating range. The device is referred to as an enhancement mode device because of the analogy of its operation with that of an enhancement mode field effect transistor. For a given set of fixed voltages on the positive and negative lens electrodes, the threshold voltage ($V_T$) is adjusted by the position of the cathode relative to the negative lens element 5B. The anode current characteristics for this device are similar to that shown in FIG. 5 with $V_{GK}$ having values under the legend "ENHANCEMENT MODE".

Referring next to FIG. 10, a depletion mode structure is shown, wherein the leg 5B of the negative lens conductor 5 is located quite a long distance from cathode 7. In this case, the field produced by the positively biased lens conductor 5A is greater than the opposite electric field produced by the negatively biased lens element 5B. This net electric field tends to turn on the cathode. Thus, the anode current $I_A$ flows in the device even though the grid voltage $V_{GK}$ is 0. The anode current characteristic of this device is similar to that shown in FIG. 5 with $V_{GK}$ having values under the legend "DEPLETION MODE". The device is referred to as a depletion mode device by analogy to a depletion mode FET. The threshold voltage ($V_T$) of this device is negative and, in a manner similar to the enhancement mode device, the threshold voltage is adjusted by the position of the cathode relative to the positive lens element 5A.

In FIGS. 8, 9, and 10, the conductor 20A connected to the cathode performs the function of suppressing secondary electrons and acts as a shield that prevents the insulating substrate from charging up.

Figure 4:
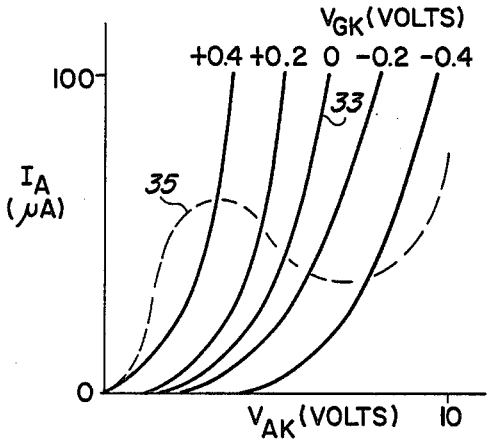
FIG. 4 is a family of anode current versus voltage curves for the triode structure of FIG. 7.

Referring next to FIG. 11, a structure is shown for a device having a negative resistance portion in its anode current characteristic. Dotted line 35 in FIG. 4 illustrates generally the appearance of this negative resistance characteristic. In this device, there is no positive lens element. As electrons from the cathode impinge on the anode, secondary electrons are emitted by the anode. If we bias the grid to at least a certain positive voltage (e.g. 2–10 volts), the grid will be positive enough to overcome the work function of the grid metal, and so the grid will collect the secondary electrons emitted by the anode. The closer the magnitude of the grid voltage is to the anode voltage, the more secondary electrons the grid will be able to collect. Since the anode is losing electrons, the anode current must decrease, and this gives rise to the negative resistance characteristics. As the anode voltage gets larger compared to the grid voltage, there will be an electric field pointing from anode to grid which tends to suppress the secondary emission. Thus, for large values of anode voltage, there is no negative resistance region.

Referring now to FIG. 12, a guard shield ring designated by reference numeral 24 is provided between negative lens element 5 and the area 25 within which one of the above-described active devices is located. Conductive guard shield ring 24 provides electrostatic isolation between the device and top member 5 of the negative lens structure. The right and left sides of the ground shield elements 24A and 24B prevent charging up of the insulating substrate. Bottom elements 24C also provide electrostatic isolation between the device and bottom member 5C of the negative lens structure. Shield 24D provides electrostatic isolation between devices. The further the devices are from each other the better the elctrostatic isolation between the devices. The widths of grounded shields 24D can be made sufficiently wide to provide the needed degree of electrostatic isolation between the active device areas 25, 25A, 25B and 25C.

In FIG. 13, a structure is shown in which a conductive top shield 29, which is grounded and is located a distance d from the top surface of substrate 2, whereon various ones of the above-described active elements can be formed and interconnected to form suitable circuits, such as amplifiers, oscillators, logic circuits, etc. FIG. 13 also shows a modified substrate structure including an upper and lower insulating substrate layer 27 and 27A inside of which is sandwiched an intrasubstrate metal shield 26 which heater element 28 supported by layer 27A. The advantage of this structrue is that it avoids electrostatic interaction between the heater 28 and the active devices formed on the upper surface of saphire substrate layer 27 and also provides for more uniform heating of the substrate.

Those skilled in the art will appreciate that the structures described above can function as active devices with gain amplification, or as load devices, in which case, the ones of the above-described devices having high anode or plate resistance, connected as constant current sources would be most effective. However, passive elements could also be formed on the upper surface of the insulating substrate 2 to function as load resistors. Ordinarly, however if thermionic cathodes are used, the high temperatures prevent use of passive elements because there are no known materials which can be used to make reliable resistors over a wide resistance range at these high temperatures. However, if cold cathode structures are used, then resistive materials could be utilized.

Those skilled in the art will realize that with the above-described passive elements, a nearly limitless number of practical implementations of amplifiers, differential amplifiers, and logic circuits can be provided.

Thus, the above-described invention provides a means for implementing economical, stable vacuum integrated circuits capable of higher temperature, more radiation resistant operation than conventional integrated circuits. The described structure can be implemented by less complex manufacturing processes, and is less dependent on small variations in process variables than is the case for conventional integrated circuits. The circuit operating characteristics are less dependent on parameters of the materials utilized than is the case for conventional integrated circuits.

While the invention has been described with reference to a particular embodiment thereof, those skilled in the art will be able to make various modifications to the described embodiments without departing from the true spirit and scope of the invention. For example, the dimensions indicated for the prototype device described could be smaller than those indicated, in which case the various bias and signal voltages could be less.

I claim:

1. A vacuum integrated circuit comprising:

(a) an insulating substrate;

(b) a vacuum envelope for producing a vacuum over a surface of the substrate;

(c) cathode means on the surface for emitting electrons into the vacuum;

(d) grid means on the surface adjacent to the cathode means for controlling the velocity of emitted electrons;

(e) anode means on the surface adjacent to the grid means for collecting emitted electrons to produce an anode current; and (f) electrostatic lens means on the surface adjacent to and in spaced relationship to the cathode means, grid means, and anode means for producing an electric field in the vacuum to control the trajectories of electrons emitted from the cathode means so that the electrons travel to the anode means and for preventing emitted electrons that are not collected by the anode means from charging up other surfaces in the vacuum.

2. The vacuum integrated circuit of claim 1 wherein the cathode means includes a thermionic cathode, the vacuum integrated circuit including means for heating the substrate to a sufficiently high temperature to cause thermionic emission from the thermionic cathode.

3. The vacuum integrated circuit of claim 1 wherein the cathode means includes a cold cathode.

4. The vacuum integrated circuit of claim 1 wherein the electrostatic lens means includes a first negative conductive lens element adjacent to the anode means and a second negative conductive lens element adjacent to a side of the grid means opposite to the anode means.

5. The vacuum integrated circuit of claim 4 wherein the electrostatic lens means includes a positive conductive lens element between the anode means and the grid means, the second negative conductive lens element being on a side of the grid means opposite to the positive conductive lens element.

6. The vacuum integrated circuit of claim 5 wherein the positive conductive lens element is included in the anode means.

7. The vacuum integrated circuit of claim 5 wherein the anode means includes a first narrow extension between the positive conductive lens element and the grid and a second narrow extension between the grid and the second negative lens element, the anode means, the cathode means, and grid means forming a triode.

8. The vacuum integrated circuit of claim 5 wherein the anode means, cathode means, and grid means are included in a first active device, the vacuum integrated circuit including a plurality of additional active devices and conductive interconnections between their various anode means, grid means, and cathode means to form an operative integrated circuit.

9. The vacuum integrated circuit of claim 5 including a conductive shield means on the surface adjacent to and spaced from both the anode means and the grid means and connected to the cathode means for suppressing secondary electrons from the anode.

10. The vacuum integrated circuit of claim 5 wherein the grid means is electrically connected to the cathode means so that the anode means, cathode means, and grid means form a constant current source, the output current of the current source being controlled by the position of the cathode between the positive conductive lens element and the second negative conductive lens element.

11. The vacuum integrated circuit of claim 5 including a heat shield disposed in the vacuum above the surface of the substrate in the vacuum for reflecting heat from the surface back toward the surface, said heat shield being electrically grounded.

12. The vacuum integrated circuit of claim 9 wherein the device including the cathode means, grid means, anode means, electrostatic lens means, and conductive shield means is an enhancement mode device, wherein the conductive shield means includes a relatively wide portion between the grid means and the positive conductive lens element and a relatively narrow portion between the positive conductive lens element and the anode means.

13. The vacuum integrated circuit of claim 9 wherein the device including the cathode means, grid means, anode means, electrostatic lens means, and conductive shield means is a depletion mode device, wherein the conductive shield means includes a relatively wide portion between the grid means and the second negative conductive lens element, a first relatively narrow portion between the grid element and the positive conductive lens element, and a second relatively narrow portion between the positive conductive lens element and the anode means.

14. The vacuum integrated circuit of claim 9 wherein the device including the cathode means, grid means, anode means, electrostatic lens means, and conductive shield means is a constant current source device, wherein the conductive shield means includes a relatively wide first portion between the grid means and the second negative conductive lens element, a relatively narrow portion between the anode means and the positive conductive lens elemnet, and a portion of intermediate width between the positive conductive lens element and the grid means.

15. A method of operating a vacuum integrated circuit comprising the steps of:

(a) providing a substrate and a vacuum envelope, producing a vacuum, an anode, a grid, and a cathode disposed on the substrate in the vacuum, and a plurality of electrostatic lens elements on the substrate;

(b) applying a sufficient voltage between the cathode and the anode to cause the cathode to emit electrons into the vacuum; and (c) applying voltages to the electrostatic lens elements to produce a pseudo-radial electrostatic field that focuses nearly all of the emitted electrons from the cathode to the anode;

whereby at most a negligible number of the emitted electrons travel to and charge up surfaces bounding the vacuum.

16. The method of claim 15 wherein step (c) includes causing the pseudo-radial electrostatic field to produce pseudo-radial field lines extending from locations between the grid and the anode and also outward over the grid and cathode and back to the surface.

* * * * *